US007158360B2

(12) United States Patent
Satoh et al.

(10) Patent No.: US 7,158,360 B2
(45) Date of Patent: Jan. 2, 2007

(54) SOLENOID DRIVE CIRCUIT

(75) Inventors: Kiyokatsu Satoh, Niiza (JP); Masaki Kanazawa, Niiza (JP)

(73) Assignee: Sanken Electric Co., Ltd., Saitama (JP)

( * ) Notice: Subject to any disclaimer, the term of this patent is extended or adjusted under 35 U.S.C. 154(b) by 195 days.

(21) Appl. No.: 10/942,589

(22) Filed: Sep. 15, 2004

(65) Prior Publication Data

US 2005/0105239 A1 May 19, 2005

(30) Foreign Application Priority Data

Nov. 18, 2003 (JP) ..... P2003-388463

(51) Int. Cl.
*H01H 9/00* (2006.01)

(52) U.S. Cl. ..... 361/154; 361/159; 361/160

(58) Field of Classification Search ..... 361/160, 361/159, 154
See application file for complete search history.

(56) References Cited

U.S. PATENT DOCUMENTS 5,191,504 A * 3/1993 Narisawa et al. ..... 361/186

* cited by examiner

*Primary Examiner*—Stephen W Jackson
*Assistant Examiner*—Terrence Willoughby
(74) *Attorney, Agent, or Firm*—Bachman & LaPointe, P.C.

(57) ABSTRACT

A solenoid drive circuit includes a control circuit which comprises a detector with a resistor for discerning current flow therethrough to produce electric signals that correspond to level of current flow through a solenoid connected to the resistor; an amplifier for amplifying the electric signals from the resistor; and an integrator for integrating the amplified output from the amplifier.

14 Claims, 4 Drawing Sheets

SOLENOID DRIVE CIRCUIT

TECHNICAL FIELD

This invention relates to a solenoid drive circuit, in particular, of a type capable of controlling current flow through a solenoid in good responsiveness to detected values of current flow through the solenoid with high accuracy.

BACKGROUND OF THE INVENTION

FIG. 4 illustrates a prior art solenoid drive circuit which comprises a DC power source 1; a switching element or MOSFET 10 and a solenoid 4 connected in series to DC power source 1; a PWM (Pulse Width Modulation) controller 23 for supplying drive signals S23 of controlled pulse width to a control or gate terminal of n-channel MOSFET 10 to alternately turn on and off MOSFET 10; and a control circuit 22 for producing command signals S25 to PWM controller 23. Control circuit 22 has a detector 6 composed of a resistor 6*a* which detects current flow I1 through solenoid 4 to produce an electric voltage equivalent to the level of current flow I1. Positive and negative terminals of DC power source 1 are connected respectively to a main or drain terminal of MOSFET 10 and earth. For example, the other main or source terminal of MOSFET 10 is grounded through solenoid 4 and detector 6 of control circuit 22. PWM controller 23 produces drive signals S23 to gate of MOSFET 10 to alternately turn on and off MOSFET 10 under control of current flow I1 through solenoid 4.

Control circuit 22 also includes an amplifier 7 for amplify the electric voltage applied on resistor 6*a*; a retention circuit 32 for sampling and retaining outputs S7 from amplifier 7; an A/D converter 13 for converting a voltage value S32 in retention circuit 32 into digital values S13; and an operational comparator or CPU 25 for comparing digital values S13 from A/D converter 13 with an objective current flow value to produce to PWM controller 23 outputs S25 indicative of the objective current flow value for solenoid 4. Source terminal of MOSFET 10 is connected to a cathode terminal of a diode 11 and an end of solenoid 4, and an anode terminal of diode 11 is grounded. Resistor 6*a* has one end connected to solenoid 4 and the other end connected to ground to detect current flow through solenoid 4. Both ends of resistor 6*a* are also connected to inverted and non-inverted terminals of amplifier 7 whose output terminal is connected to an input terminal of retention circuit 32. Output terminal of retention circuit 32 is connected to an input terminal of A/D converter 13 whose output terminal is connected to an input terminal of operational comparator 25.

Operational comparator 25 receives output signals S22 from at least one of sensors not shown such as an accelerator sensor, speed sensor, hydraulic pressure sensor or other sensors equipped in an automobile to calculate an objective current flow value for solenoid 4 based on output signals S22. Also, operational comparator 25 counts digital signals S13 indicative of detected current flow values from A/D converter 13, calculates a mean current flow value, and produces instruction signals S25 representative of current flow indication based on the mean current flow value and objective current flow value so that operational comparator 25 supplies instruction signals S25 to an input terminal of PWM controller 23 to determine a duty ratio of drive signals S23 to MOSFET 10 in PWM controller 23 in view of instruction signals S25 of current flow indication. Specifically, operational comparator 25 serves to optimize the level of current flow through solenoid 4 such that operational comparator 25 decreases current flow indication of instruction signals S25 when the detected current flow value is higher than the current objective value, and therefore, PWM controller 23 receives the decreased current flow indication of instruction signals S25 and lowers or narrows the duty ratio of drive signals S23 to MOSFET 10 accordingly to reduce the current flow through solenoid 4. Adversely, when the detected current flow value is lower than the current objective value, PWM controller 23 boosts or widens the duty ratio of drive signals S23 to MOSFET 10 based on current flow indication of instruction signals S25 to increase the current flow through solenoid 4. Thus, operational comparator 25 produces current flow indication of instruction signals S25 based on voltage value applied on resistor 6*a*, and thereby, PWM controller 23 produces drive signals S23 of controlled pulse width to MOSFET 10 to optimize current flow through solenoid 4.

For example, Japanese Patent Disclosure No. 2002-319506 discloses a solenoid drive circuit with a retention circuit as shown in FIG. 4. Detected voltage held in retention circuit 32 is converted into digital values through A/D converter 13 and supplied to operational comparator 25 which then calculates mean value of current flow from the detected voltage of digital value to produce to PWM controller 23 instruction signals S25 of current flow indication based on a deviation between the calculated mean value and objective current flow value. Accordingly, responsiveness of the system is determined by point number or length of point interval of sampling.

It should be noted that the solenoid drive circuit shown in FIG. 4 is defective because it cannot be operated with accuracy when resistor 6*a* detects a noise-superimposed voltage associated with switching operation of MOSFET 10 or a surge or voltage movement due to sudden voltage fluctuation of power source. Although a large amount of data can be sampled with retention circuit 32 for a short period of time to calculate mean current values and improve control accuracy of solenoid 4, however, this method increases number of the computation due to processing of the large amount of data and results in increased operation load on operational comparator 25.

Another solenoid drive circuit shown in FIG. 5 comprises an integrator 38 in lieu of retention circuit 32 of FIG. 4 to avoid inaccuracy in operating the solenoid drive circuit because integrator 38 can absorb noise to some extent. However, the solenoid drive circuit indicates the degraded responsiveness or deteriorated controllability with overshoot or undershoot when current flow is varied in response to external factors in case integrator 38 involves a large time constant for electric charge and discharge.

An object of the present invention is to provide a solenoid drive circuit capable of controlling current flow through a solenoid in good responsiveness to detected values of current flow through the solenoid without increase of operation load to be processed in the solenoid drive circuit. Another object of the present invention is to provide a solenoid drive circuit capable of driving a solenoid with an improved controllability without processing a large amount of current flow data on the solenoid.

SUMMARY OF THE INVENTION

The solenoid drive circuit according to the present invention includes a control circuit (2) which comprises a detector (6) for discerning current flow therethrough to produce electric signals that corresponds to level of current flow through a solenoid (4); an amplifier (7) for amplifying the electric signals from the detector (6); and an integrator (8) for integrating the amplified output (S7) from the amplifier (7). As the integrator (8) is reset each time a PWM controller (3) generates at least one of the successive drive signals (S3), an operational comparator (5) receives the updated and integrated values (S8) of relatively small amount from the integrator (8), easily and promptly compares the latest values (S8) from the integrator (8) and an objective current values, produces a command value (S5) indicative of a deviation of the integrated values (S8) from the objective current value and provides the command value (S5) to the PWM controller (3). As the PWM controller (3) provides the control terminal of a switching element (10) with the drive signals (S3) of pulse width which corresponds to the command value (S5) from the operational comparator (5), the current flow through the solenoid (4) can be controlled for accurate activation of the solenoid (4) in good responsiveness to current flow values through the solenoid (4).

BRIEF DESCRIPTION OF THE DRAWINGS

The above-mentioned and other objects and advantages of the present invention will be apparent from the following description in connection with preferred embodiment shown in the accompanying drawings wherein.

BEST MODE FOR CARRYING OUT THE INVENTION

Figure 1:
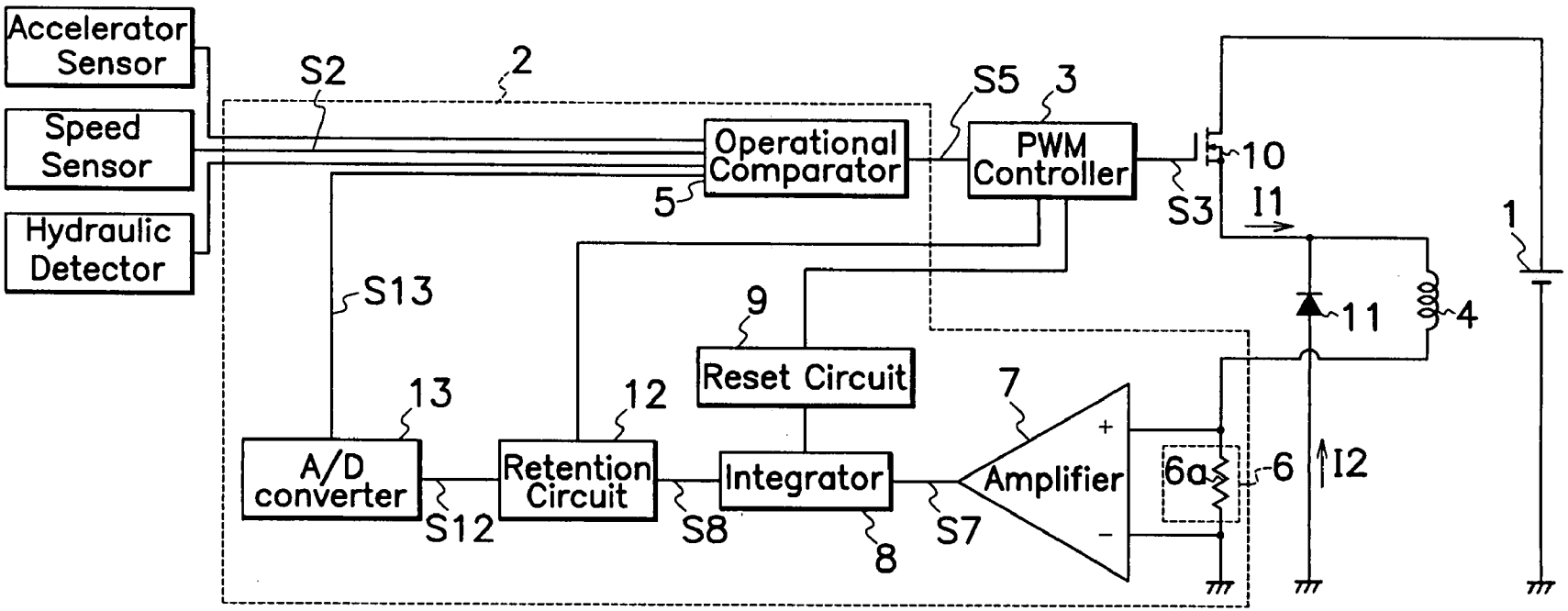
FIG. 1 is an electric circuit diagram showing a solenoid drive circuit according to an embodiment of the present invention.
Figure 2:
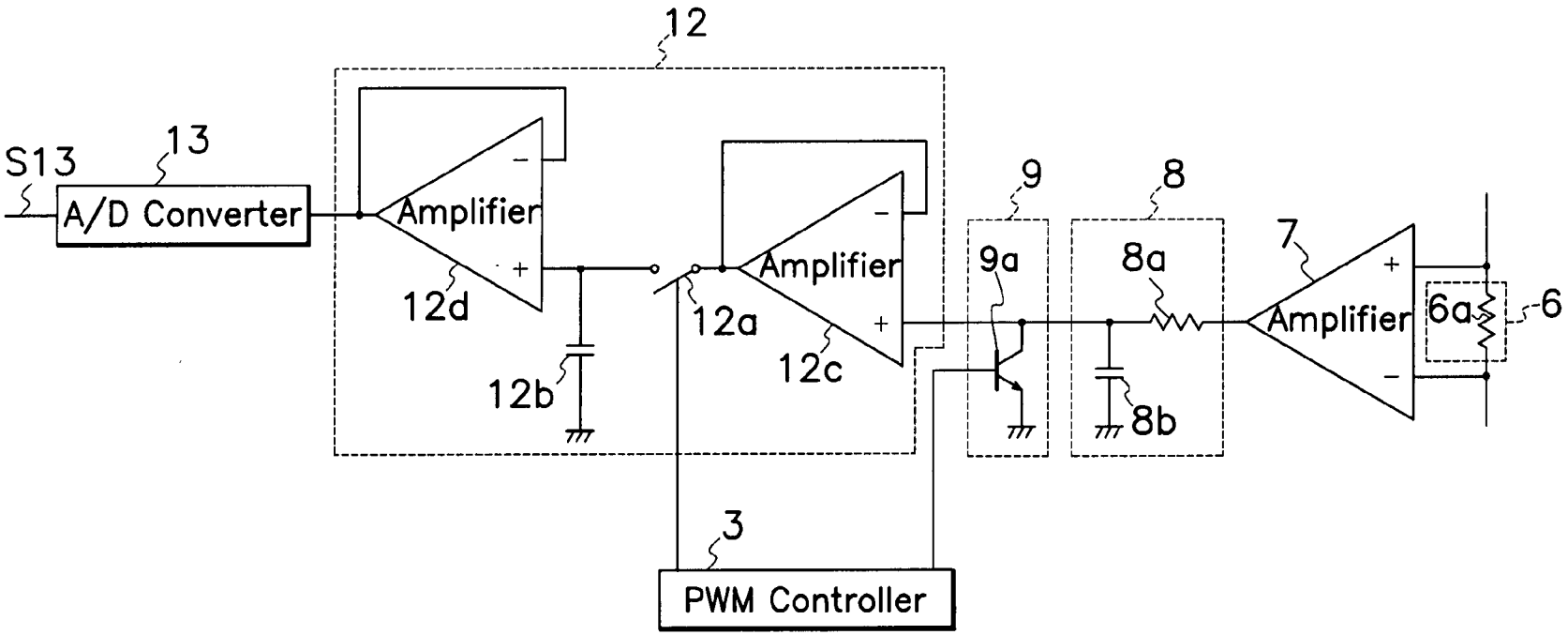
FIG. 2 is a detailed electric diagram of an integrator, retention circuit and reset circuit shown in FIG. 1.
Figure 3:
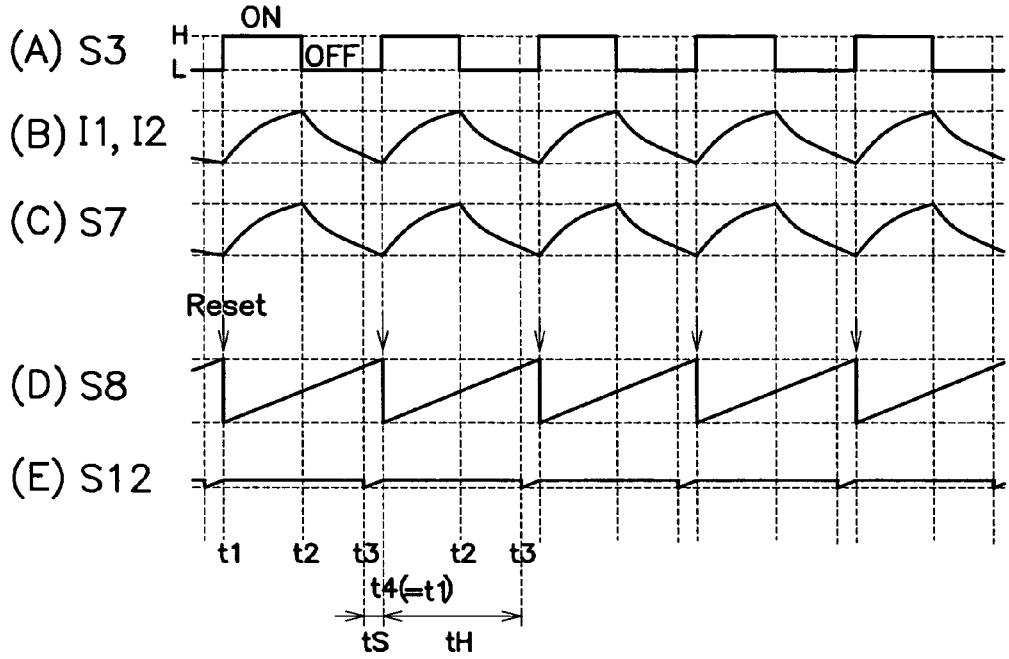
FIG. 3 shows time charts of electric circuitries shown in FIG. 1 to operate the solenoid drive circuit.
Figure 4:
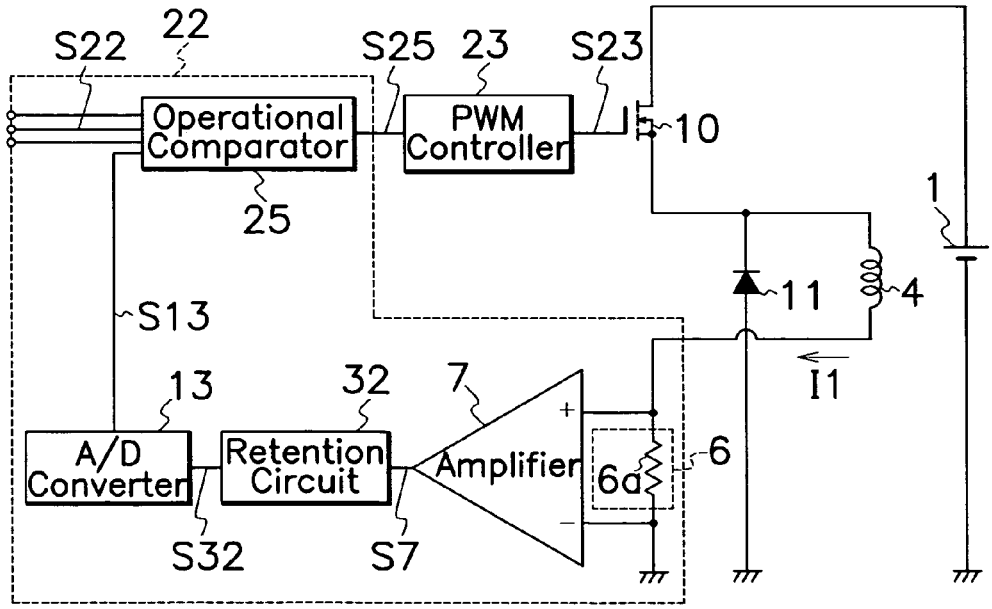
Fig. 4 Prior Art
FIG. 4 is a first circuit diagram of a prior art solenoid drive circuit.
Figure 5:
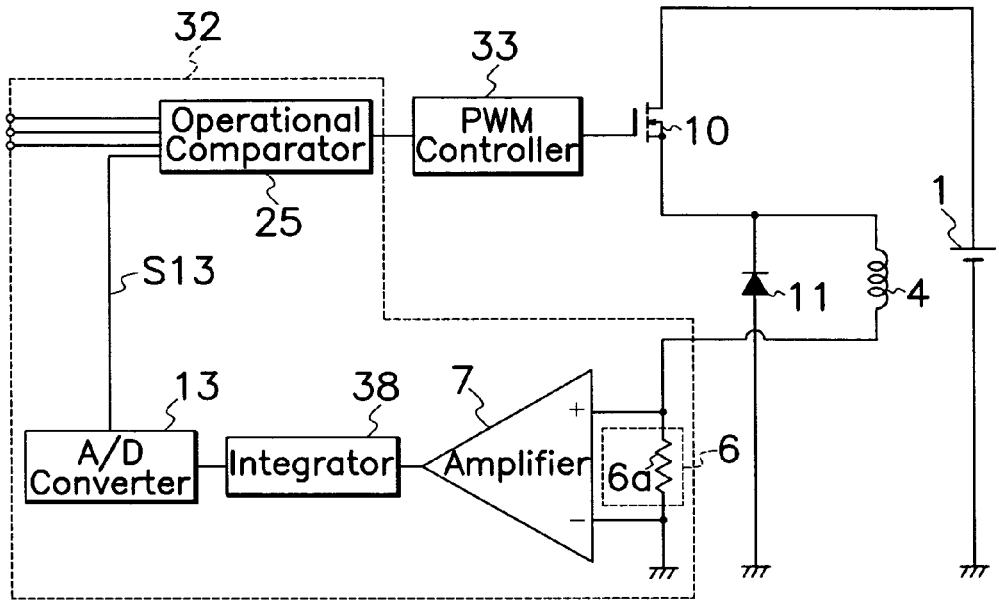
Fig. 5 Prior Art
FIG. 5 is a second circuit diagram of another prior art solenoid drive circuit.

FIGS. 1 to 3 illustrate an embodiment of the solenoid drive circuit according to the present invention. Same reference symbols as those in FIGS. 4 and 5 are applied in FIGS. 1 to 3 to show the substantially same elements.

As shown in FIG. 1, a control circuit 2 comprises an integrator 8 for integrating amplified outputs S7 of amplifier 7; a retention circuit 12 for receiving and retaining integrated outputs S8 of integrator 8; an A/D converter 13 for converting outputs S12 from retention circuit 12 into digital signals S13; an operational or computing comparator 5 for receiving outputs S13 from A/D converter 13 and input signals S2 from various sensors of the type same as or similar to the foregoing. Operational comparator 5 calculates the objective value for solenoid current flow based on input signals S2.

As shown in FIG. 2, integrator 8 comprises a resistor 8*a* connected between an output terminal of amplifier 7 and an input terminal of retention circuit 12; and a capacitor 8*b* connected between ground and a junction of resistor 8*a* and input terminal of retention circuit 12 for accumulating and integrating amplified electric signals detected by detector 6. In the illustrated embodiment, reset circuit 9 is shown to form a controllable short circuit with a transistor 9*a* whose collector and emitter terminals are respectively connected to an electrode of capacitor 8 and ground for parallel connection between capacitor 8 and transistor 9*a*.

Retention circuit 12 comprises first and second amplifiers 12*c* and 12*d*; a switch 12*a* provided in a line between an output terminal of first amplifier 12*c* and a non-inverted input terminal of second amplifier 12*d*; and a capacitor 12*b* connected between non-inverted input terminal of second amplifier 12*d* and ground. First amplifier 12*c* has a non-inverted input terminal connected to resistor 8 and an inverted input terminal connected to an output terminal of first amplifier 12*c*. Second amplifier 12*d* has an inverted input terminal connected to its output terminal which is then connected to A/D converter 13.

When the detected current flow value is higher than the current objective value, operational comparator 5 decreases current flow indication of command signals S5, and PWM controller 3 receives the decreased command signals S5 and lowers or narrows the duty ratio of drive signals S3 to MOSFET 10 accordingly to reduce the current flow through solenoid 4. Adversely, when the detected current flow value is lower than the current objective value, PWM controller 3 boosts or widens the duty ratio of drive signals S3 to MOSFET 10 based on command signals S5 to increase the current flow through solenoid 4.

When PWM controller 3 supplies a control signal to a base terminal of transistor 9*a* of reset circuit 9, transistor 9*a* is turned on to discharge the electric charge of capacitor 8*b*, thereby causing integrator 8 to be reset to a zero output. In this way, reset circuit 9 initializes output of integrator 8 per cycle of drive signals S3 from PWM controller 3. Simultaneously, PWM controller 3 provides control signals to turn on and off switch 12*a* to close and open the circuit through switch 12*a* between integrator 8 and capacitor 12*b* through first amplifier 12*c*. Specifically, when switch 12*a* is turned on to close the path between capacitor 8*b* of integrator 8 and capacitor 12*b* of retention circuit 12, capacitor 12*b* is charged by electric charge of capacitor 8*b* of integrator 8 to a same voltage level as that of capacitor 8*b*. When switch 12*a* is turned off to open the path between capacitor 8*b* of integrator 8 and capacitor 12*b* of retention circuit 12, capacitor 12*b* maintains the charged voltage therein until switch 12*a* is then turned on for a next cycle.

As A/D converter 13 converts integrated values retained in retention circuit 12 into digital values, operational comparator 5 receives the digital signals of integrated value S13 from A/D converter 13. Like a prior art solenoid drive circuit does, operational comparator 5 includes an operational means for calculating the objective value of solenoid current flow, and an output means for forwarding command signals S5 of solenoid current indication value to PWM controller 3. Operational comparator 5 calculates the objective value making use of output signals S2 from various sensors as mentioned above, compares the digital signals S13 with the objective value of current flow through solenoid 4 to produce a deviation and provide PWM controller 3 with a command signal S5 of current flow indication based on the deviation.

As integrator 8 is reset each time PWM controller 3 generates one of the successive drive signals S3, operational comparator 5 receives the latest updated and integrated values S8 of relatively small amount from integrator 8 to easily and promptly compare the updated values S8 from integrator 8 and objective current values, and produce a deviation of the integrated values S8 from the objective current value and provide PWM controller 3 with a command value S5 indicative of the deviation. Accordingly, as PWM controller 3 provides gate terminal of MOSFET 10 with drive signals S3 of pulse width which corresponds to command value S5 from operational comparator 5, the current flow through solenoid 4 can be controlled for accurate activation of solenoid 4 in good responsiveness to current flow values through solenoid 4. Also, although detector 6 picks out abnormal signals such as a noise-superimposed voltage associated with switching operation of MOSFET 10 or a surge or voltage movement due to sudden voltage fluctuation of power source, integrator 8 smoothes or averages such abnormal signals to a lower level which do not result in any substantial error in operating solenoid 4. Consequently, the drive circuit does neither require sampling of voltage data mass or a large capacity resource for operational comparator 5 of CPU for processing large data for a short period of time to accurately operate solenoid 4, nor large operational load which increases the operational number of operational comparator 5. Accordingly, the solenoid drive circuit according to the present invention can control the driven solenoid 4 in high accuracy and good responsiveness for electrically controlled devices in automobile, and utilize inexpensive operational comparator or CPU 5 without increment of operational load to operational comparator 5. The present invention also is advantageous in that PWM controller 3 adjusts duty ratio or pulse width of drive signals S3 to MOSFET 10 in response to drive signals S5 from operational comparator 5 to optimize current flow through solenoid 4.

FIG. 3 (A) to (E) show time charts of output signals from the main circuits in the solenoid drive circuit. As seen from FIG. 3(A), PWM controller 3 provides gate terminal of MOSFET 10 with drive signals S3 of alternating high and low level voltages. MOSFET 10 is turned on during a period of time from t1 to t2 while drive signal S3 is in the high level to connect one end of solenoid 4 to anode terminal of power source 1 so that electric current flow from power source 1 through MOSFET 10, solenoid 4 and resistor 6*a* to ground. Immediately after turning on of MOSFET 10 at the time point t1, the value of current flow I1 increases with the lapse of time as shown in FIG. 3(B) up to the maximum at the time point t2.

Then, drive signal S3 is switched to lower level voltage during a period of time from the time point t2 to t4 to turn off MOSFET 10 interrupting the connection of solenoid 4 to power source 1, and therefore, electromotive force produced in solenoid 4 causes regenerative electric current I2 to flow from ground through diode 11, solenoid 4 and resistor 6*a* to ground. Immediately after turning off of MOSFET 10 at the time point t2, the value of regenerative electric current I2 decreases with the lapse of time.

Applied across resistor 6*a* is a voltage of the level which is proportional to the amount of current flow I1 and regenerative current I2 through solenoid 4. Amplifier 7 amplifies the detected voltage applied on resistor 6*a* and forwards it to integrator 8. As inverted input terminal of amplifier 7 is grounded, non-inverted input terminal of amplifier 7 receives the detected voltage proportional to the amount of current flow I1 and regenerative current flow I2. Amplifier 7 amplifies the potential difference between the voltages received by non-inverted and inverted input terminals to represent voltage variation S7 shown in FIG. 3(C).

PWM controller 3 produces drive signals S3 to gate terminal of MOSFET 10, and simultaneously, provides reset circuit 9 with a reset signal synchronously with rise of drive signals S3 to gate terminal of MOSFET 10 so that reset circuit 9 resets output of integrator 8 to zero per cycle of drive signals S3 from PWM controller 3. As shown in FIG. 3(D), when drive signal S3 of PWM controller 3 becomes high at the time point t1, output voltage S8 of integrator 8 starts to increase from zero and continues to increase until the time point t4 (=t1) a next drive signal S3 from PWM controller 3 becomes high.

Retention circuit 12 starts sampling of integrated outputs S8 of a previous cycle for each cycle of drive signals S3 from integrator 8 at the time point t3 immediately before reset circuit 9 resets output of integrator 8 to zero to positively pick out and hold the maximum value of output voltage S8 from integrator 8 at the same time of or immediately before occurrence of a reset signal from reset circuit 9. Specifically, as shown in FIGS. 2 and 3(E), electric charge in capacitor 8*b* of integrator 8 is discharged by turning on transistor 9*a* of reset circuit 9 at the time point t1 to reset output of integrator 8 to zero level. Then, at the time point t3, capacitor 12*b* of retention circuit 12 accumulates electric charge from capacitor 8*b* of integrator 8 during a predetermined time period tS before the time point t4 until switch 12*a* is opened at the time point t4 (=t1). Subsequently, at the time point t4, switch 12*a* is opened, and capacitor 12*b* of retention circuit 12 keeps the charged voltage of the previous cycle during a period of time from the time point t1 to t3 so that A/D converter 13 can convert the charged voltage into digital signals any time during the time period between the time point t1 and t3. In FIG. 3, a time interval tS represents a sampling time or charge time for accumulating electric charge in capacitor 12*b*, and a time length tH indicates a holding time for keeping the charged voltage in capacitor 12*b*. Thus, retention circuit 12 maintains the output voltage of the previous cycle for each cycle of drive signals S3 from PWM controller 3, and then forwards it to A/D converter 13. Accordingly, operational comparator 5 reads the output voltage of the previous cycle from A/D converter 13, and provides PWM controller 3 with command signal S5 in the form of a feedback signal for optimizing the current flow value through solenoid 4.

In accordance with the solenoid drive circuit of this embodiment, as output of integrator 8 is reset to zero by reset circuit 9 in synchronization with drive signals S3 from PWM controller 3, operational comparator 5 supplies PWM controller 3 with command signals as a difference or deviation between integrated value from integrator 8 and objective current value per cycle of drive signals S3 from PWM controller 3. Therefore, current flow through solenoid 4 can be precisely controlled without delay and with good responsiveness to the current flow value through solenoid 4 detected by resistor 6*a*.

It is apparent that the embodiment of the present invention shown in FIGS. 1 to 3 can be varied in various ways and contains all and any modifications and variations which falls under the scope of the claims. For example, integrator 8 or retention circuit 12 may be formed with a digital circuit in lieu of the analog circuit as above-mentioned. Also, operational comparator 5 may be formed with an analog circuit for directly receiving the integrated output from retention circuit 12 without A/D converter 13 to generate to PWM controller 3 command signals of deviation between the integrated output and objective current value. In other words, the present invention is not limited only to the digital circuit for supplying digital outputs from A/D converter 13 to operational comparator 5, and then providing PWM controller 3 with calculated values from operational comparator 5. Instead, the invention also contemplates an analog circuit for directly forwarding outputs from retention circuit 12 to PWM controller 3 without digitalization.

The above-mentioned embodiments demonstrate integration and retention per cycle of drive signals from PWM controller 3, however, this is not limited to each cycle, and the integration and retention can be carried out per plural cycles of drive signals. For instance, the present invention contemplates integration of subsequent current values over two cycles while previous current values over two cycles is retained in retention circuit 12. For example, integrator 8 can integrate signals which correspond to the current flow discerned by resistor 6*a* from a first optional time to a second optional time of the drive signal S3 from PWM controller 3. Otherwise, integrator 8 can integrate signals which correspond to the current flow discerned by resistor 6*a* from a first optional time to a second optional time in an on-off control cycle or in plural on-off control cycles of MOSFET 10. The invention also contemplates integration of current value for a period of time shorter than a cycle for subsequent retention to obtain better responsiveness. If operational comparator 5 is formed with digital circuits, the invention's control circuit can use basic oscillation frequency of drive signals S3 from PWM controller 3, reset drive signals to reset circuit 9 and control signals to retention circuit 12 based on drive signals S3 from PWM controller 3. These circuits can be operated with the optimal timing by clock pulses from operational comparator 5. The invention also contemplates output from PWM controller 3 or operational comparator 5 to reset circuit 9 and retention circuit 12 synchronously with or based on drive signals S3 supplied to gate terminal of MOSFET 10, instead of rise edge of drive signals S3. In other words, the output to reset circuit 9 and retention circuit 12 may be produced synchronously with a predetermined point on the drive signals S3 from PWM controller 3 including leading or trailing edge of the drive signals S3.

What is claimed are:

1. A solenoid drive circuit comprising:

a DC power source;

a switching element and a solenoid connected in series to the DC power source;

a PWM controller for supplying drive signals (S3) to a control terminal of the switching element to alternately turn on and off the switching element;

a control circuit for producing command signals (S5) to control the PWM controller;

said control circuit comprising a detector for discerning current flow through said detector to produce electric signals that corresponds to level of the current flow through said solenoid;

an amplifier for amplifying the electric signals from said detector;

an integrator for integrating the amplified output (S7) from said amplifier;

an operational comparator for comparing the detected current values from the integrator and a target current value and producing command values (S5) indicative of a deviation of the detected current value from the target current value;

a reset circuit for resetting output of the integrator; and a retention circuit connected between the integrator and the operational comparator for receiving and preserving the detected current value from said integrator;

wherein said retention circuit samples the detected current value from said integrator before said reset circuit resets the output of the integrator each time the PWM controller generates at least one of the successive drive signals (S3);

said operational comparator receives the detected current value preserved in the retention circuit to compare the detected current value with the target current value; and said PWM controller provides the control terminal of the switching element with the drive signal (S3) of pulse width which corresponds to the command value (S5) from the operational comparator.

2. The solenoid drive circuit of claim 1, wherein said reset circuit initializes the output of the integrator per cycle of the drive signals (S8) from the PWM controller.

3. The solenoid drive circuit of claim 1, wherein the PWM controller produces a trigger drive signal to the reset circuit synchronously with or based on the drive signals (S3) from the PWM controller.

4. The solenoid drive circuit of claim 1, wherein the operational comparator calculates the target current value based on information sent from at least one of a plurality of sensors to the operational comparator.

5. The solenoid drive circuit of claim 1, wherein the integrator integrates signals which correspond to the current flow discerned by the detector from a first optional time to a second optional time of the drive signal (S3) from the PWM controller.

6. The solenoid drive circuit of claim 1, wherein the integrator integrates signals which correspond to the current flow discerned by the detector from a first optional time to a second optional time in an on-off control cycle or in plural on-off control cycles of the switching element.

7. The solenoid drive circuit of claim 1, wherein the retention circuit (12) preserves the previous detected current value until the next integration has been completed.

8. The solenoid drive circuit of claim 1, wherein the PWM controller produces a trigger drive signal to the reset circuit synchronously with a predetermined point on the drive signals (S3) from the PWM controller.

9. The solenoid drive circuit of claim 8, wherein the predetermined point is a leading or tailing edge of the drive signals (S3) from the PWM controller.

10. The solenoid drive circuit of claim 1, wherein at least one of the PWM controller and operational comparator produces trigger signals to activate or reset the reset circuit and retention circuit.

11. The solenoid drive circuit of claim 1, wherein the operational comparator is formed with digital circuits for producing the trigger signals.

12. The solenoid drive circuit of claim 1, wherein said operational comparator receives output signals (S2) from at least a sensor selected from the group of accelerator sensor, speed sensor and hydraulic detector equipped in an automobile to calculate the target current value for solenoid current flow.

13. The solenoid drive circuit of claim 1, wherein said operational comparator produces command signals (S5) indicative of current flow indication to said PWM controller (3) based on the deviation between the detected current value and the target current value.

14. The solenoid drive circuit of claim 1, wherein said operational comparator decreases the command signal (S5) of current flow indication when the detected current flow value is higher than the target current value;

thereby, said PWM controller receives the decreased command signal (S5) and lowers the duty ratio of the drive signals (S3) to the switching element to reduce the current flow through said solenoid;

said operational comparator increases the command signal (S5) of current flow indication when the detected current flow value is lower than the target current value;

thereby, said PWM controller receives the increased command signal (S5) and boosts the duty ratio of the drive signals (S3) to the switching element to increase the current flow through said solenoid.

* * * * *